US006945867B2

(12) United States Patent
Park

(10) Patent No.: US 6,945,867 B2
(45) Date of Patent: Sep. 20, 2005

(54) MOVABLE GRATING CONTROL

(76) Inventor: Chan-Woo Park, 297 Worth Blvd., Thornhill, ON (CA), L4J 7V9

( * ) Notice: Subject to any disclaimer, the term of this patent is extended or adjusted under 35 U.S.C. 154(b) by 0 days.

(21) Appl. No.: 10/643,180

(22) Filed: Aug. 19, 2003

(65) Prior Publication Data

US 2005/0048909 A1 Mar. 3, 2005

(51) Int. Cl.[7] ..... F24F 7/00
(52) U.S. Cl. ..... 454/324; 454/334
(58) Field of Search ..... 454/334, 333, 454/332, 265; 236/49.3

(56) References Cited

U.S. PATENT DOCUMENTS 2,936,692 A * 5/1960 White ..... 454/260
3,073,525 A * 1/1963 Cislo ..... 236/49.5
3,830,146 A * 8/1974 Kaiser ..... 454/255
4,210,200 A * 7/1980 Vary ..... 165/98
4,879,878 A * 11/1989 Polkinghorne ..... 62/187
4,964,566 A * 10/1990 Pugh et al. ..... 236/49.3
5,472,380 A * 12/1995 Sarazen et al. ..... 454/290
5,984,225 A * 11/1999 Enzinna ..... 242/415.1
6,052,999 A * 4/2000 Park et al. ..... 62/179
6,340,329 B1 1/2002 Park
6,446,876 B1 * 9/2002 Stefano et al. ..... 236/49.3
6,474,559 B2 11/2002 Park
6,694,759 B1 * 2/2004 Bash et al. ..... 62/180

FOREIGN PATENT DOCUMENTS

CA 2295891 7/2003

* cited by examiner

*Primary Examiner*—Derek S. Boles

(57) ABSTRACT

A grating assembly drive means is connected to control the movement of the movable grating between OPEN and CLOSED positions relative to a fixed grating. The drive means moves the movable grating through yieldable connection when moving toward CLOSED position, whereby when such movement is blocked by a foreign object the movable grating stops without damaging the object or the drive. On the other hand movement by the drive means toward OPEN position is direct after removal of any slack caused by a previous yielding.

16 Claims, 3 Drawing Sheets

MOVABLE GRATING CONTROL

BACKGROUND OF INVENTION

This invention relates to a control for a grating assembly of the type where a movable grating moves between OPEN and CLOSED positions relative to a fixed grating.

The OPEN position is the position where there is the largest alignment of the passages through the stationary and moving gratings within the range of movement of the movable grating. The CLOSED position is that where the movable grating fills the largest extent, within its range of movement of the passages, through the fixed grating.

In applicant's prior patents U.S. Pat. Nos. 6,340,329 and 6,744,559 there is described a temperature sensing control system wherein in the cold months the control system controls the temperature in the space fed by air flow through the grating by moving the movable grating to OPEN position to increase heat flow into the space and to CLOSED position to decrease heat flow into the space. (As the patents explain in warm weather the control system may preferably be connected to move the grating to OPEN and CLOSED positions to decrease and increase heat respectively.)

In the movable grating drive described in the patents a drive means drove the movable grating between OPEN and CLOSED positions through a yieldable drive. This drive embodied the sought for advantage that when the movable grating moved toward CLOSED position, if it met an object, then the yieldable connection allowed travel of the movable grating toward the CLOSED position to stop, (even though the drive means continued to move) to prevent damage to the object or the control system. There were not felt to be comparable advantages from the use of the yieldable drive when the grating moved toward the OPEN position.

The drive worked very well, however two disadvantages were encountered. Firstly, some considerable difficulty was encountered in installing the springs for the yieldable drive. Secondly, the drive thus constituted caused some noise. Although this noise was insignificant enough to be almost undetectable during the day, at night in an otherwise silent environment the noise of the drive could be sufficiently audible to be annoying.

BRIEF SUMMARY OF INVENTION

There is here described a drive for operating the movable grating under the control of a control system such as that described in U.S. Patent '559. In the novel drive now discussed the drive of the movable grating is yieldable when the grating is moving toward CLOSED position (thus avoiding damage to an impeding object or the drive) but the drive is direct when the grating is moved toward OPEN position. (In moving toward OPEN position the drive will first 'take up' any lost motion due to yielding in the travel toward CLOSED position and then direct drive the movable grating toward CLOSED position.)

It is found that the novel drive is more easy to install than the drive shown in patents '329 and '559 and it is less audible than the previously patented drive.

Governed by the drive control therefore a drive means is adapted to move alternately in a closing and in an opening direction relative to the movable grating. The drive means is connected for movement of the movable grating in the closing direction while drawing the movable grating through a yieldable connection. The drive means is connected for movement in the opening direction by a drive connection which first takes up any slack present due to yielding on prior movement in the closing direction, and thereafter the direct drives the movable grating toward OPEN position.

Thus the drive means and the movable grating are preferably connected by a resilient tension member, preferably a coiled spring so that on closing movement the movable grating encountering an object will stop and stretch the spring and avoid damage to the object or the drive. On the other hand an attachment connected to the drive means is located to contact an attachment on the movable grating on movement of the drive means in the opening direction. (Such contact will take place after any spacing has been closed due to a previous yielding on previous movement in the closing direction.) Thus the contact of the two attachments will allow the drive means to move the movable grating in the opening direction to OPEN position.

Such drive is found easier to install than the springs shown in Patent '329 and is found to be less audible.

The drive means is preferably connected to the movable grating by a tension spring arranged to pull movable grating in the direction of the CLOSED position. Thus in the event that a finger or other object is located to interfere with movement toward such CLOSED position, the spring will stretch and injury to the finger or other object will be avoided, as will damage to the drive. (Thus the spring is strong enough to pull the movable grating against friction but weak enough to stretch without movement of the movable grating when the latter encounters a solid impediment.)

On the other hand the drive means is connected to the movable grating so that on motion of the drive means to direct the movable grating towards OPEN position it will first take up any movement due to remaining spring extension from any earlier movement toward CLOSED position and then positively drive the grating toward OPEN position.

DETAILED DESCRIPTION OF THE INVENTION

Figure 1:
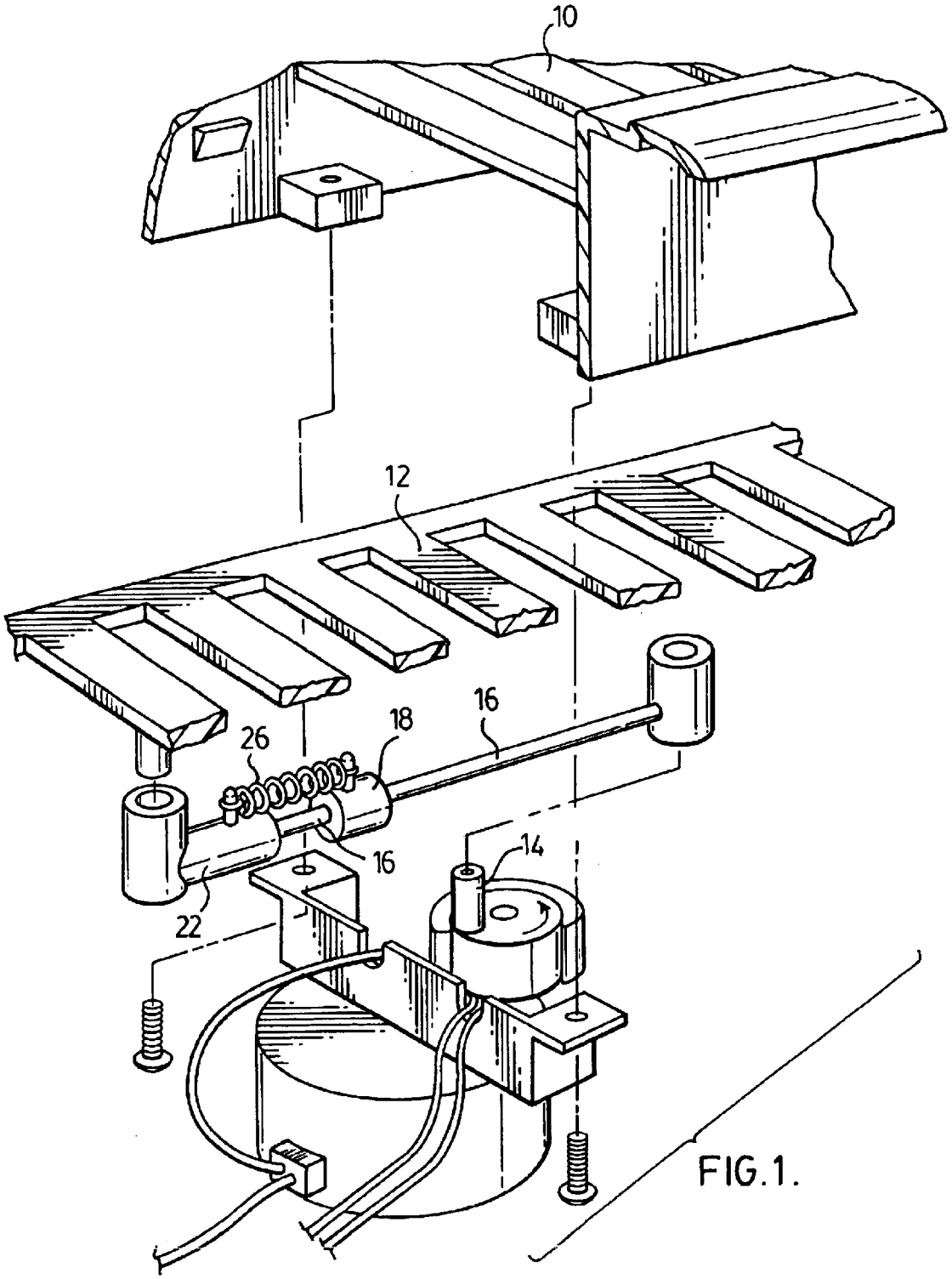
FIG. 1 is a schematic and exploded view demonstrating the relationship of the drive means to the movable grating.

In the drawings, a grating assembly controlling airflow therethrough into a space comprises a stationary grating 10 and a movable grating 12. In accord with a control of the type shown in U.S. Pat. Nos. 6,340,329 and 6,474,559 the movable grating is moved between a first limit position where the grating assembly allows substantial air passage, (the OPEN position, FIG. 2) and a second limit position which allows minimum air flow, (the CLOSED position, FIG. 3).

In accord with the '329 patent, the temperature in the space receiving air flow through the grating assembly is thermostatically controlled to alternately call for OPEN or CLOSED positions to increase or decrease respectively the increase flow of heated air through the assemblies (in the winter). As described in the '329 patent the control may also be designed so that in the summer the grating may assume the OPEN and CLOSED positions to respectively cool and heat the space in the summer.

The '559 patent describes a drive for the movable grating which yields to opposing pressure if there is opposition to movement. This has the advantage, when the grating is moving toward the CLOSED position that someone's fingers or another object will not be injured or damaged nor will the drive mechanism. The advantage of a yieldable drive is less apparent when the movable grating is moving toward OPEN position.

Accordingly the present invention provides a yieldable drive when the movable grating is moving toward CLOSED position and a direct drive when the movable grating is moving toward OPEN position (after any yielding has been removed from the previous movement toward CLOSED position).

Figure 2:
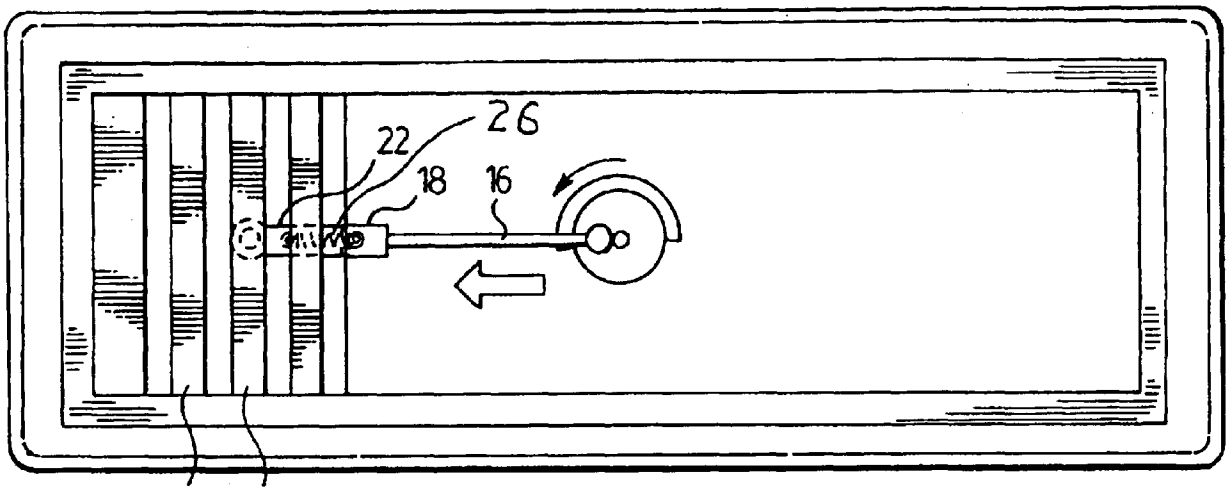
FIG. 2 shows the movable grating located in OPEN position relative to the stationary grating.
Figure 3:
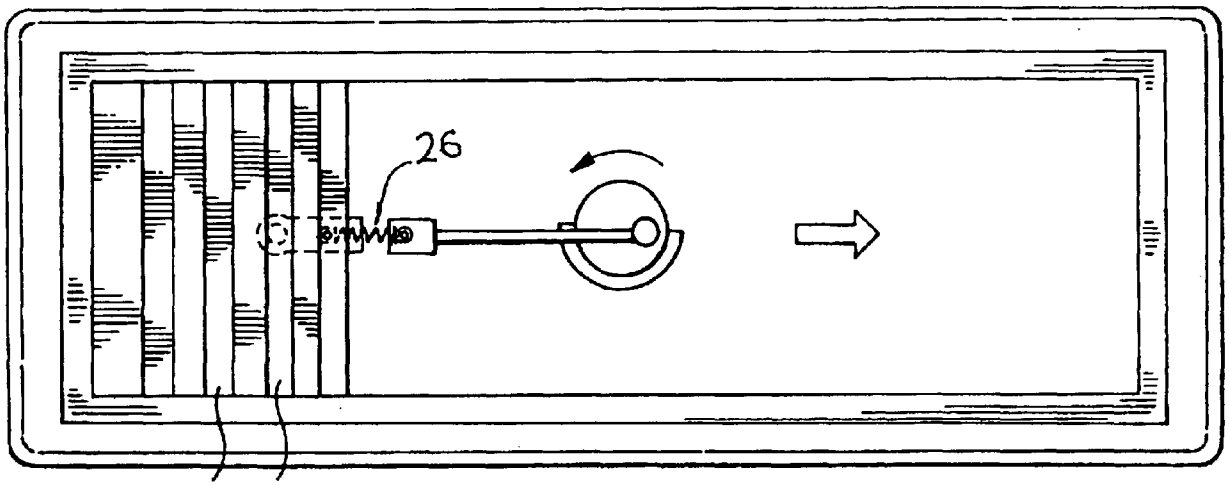
FIG. 3 shows the movable grating located in CLOSED position relative to the stationary grating.

Accordingly as best shown in FIGS. 1, 2, and 3, the control provides a rotating drive means, always rotating in one direction, which is connected to drive a rod 16 which carries attachment 18 movable therewith. Rod 16 also projects through rod 18 into a bore 20 in attachment 22 which is attached to and movable with the movable grating 12. Attachment 22 and attachment 18 are connected by a helical tension spring 26.

Figure 4:
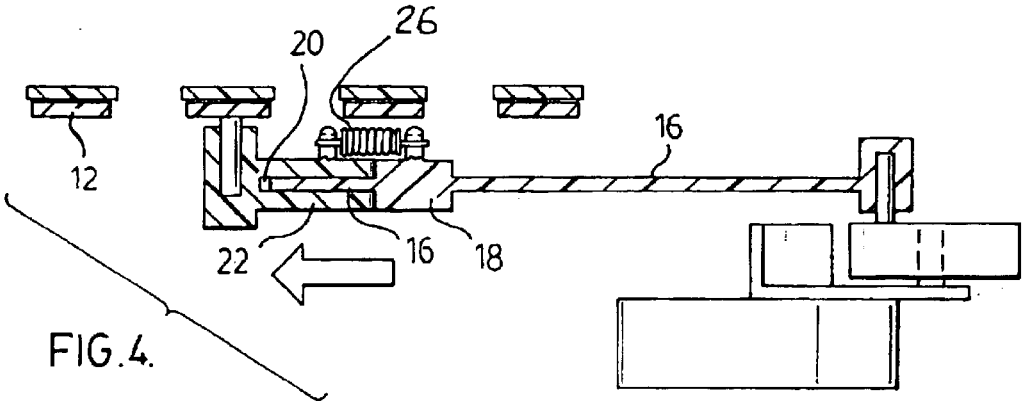
FIG. 4 shows the drive means and the movable grating after moving the movable grating to OPEN position.

When drive means 14 rotates to move rod 16 and attachment 18 toward the opening direction (FIG. 4), the rod 16 moves into bore 20 until attachment 18 contacts attachment 22 and drives the movable grating 12 to OPEN position.

Figure 5:
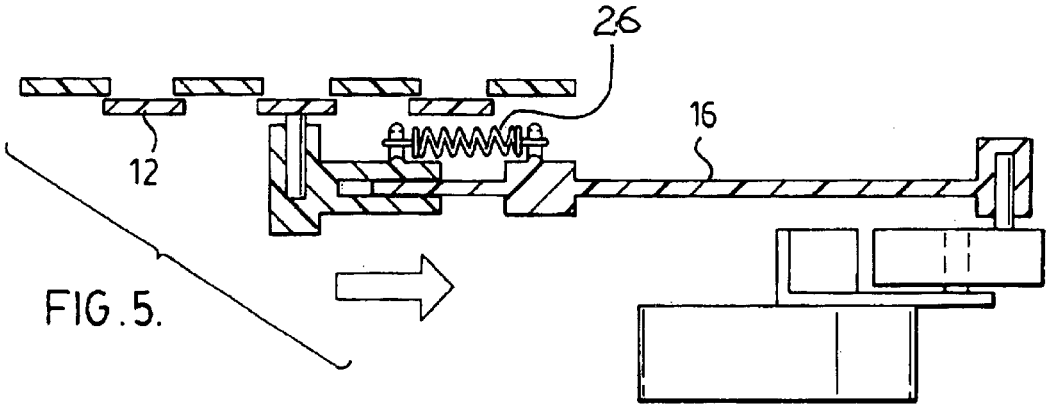
FIG. 5 shows the drive means and the movement after moving the movable grating to CLOSED position without interference.

When drive means 14 moves rod 16 toward opening direction (FIGS. 5 and 6) then if there is no object to interfere with movement of the grating 12 (FIG. 5) the spring moves the grating 12 toward CLOSED position with a small spring extension.

Figure 6:
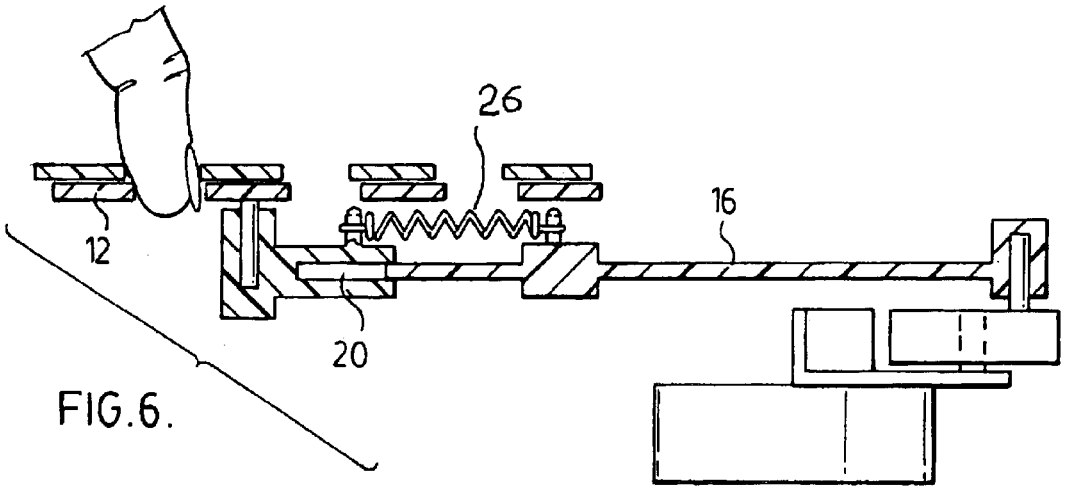
FIG. 6 shows the drive means positioned to drive the movable grating to CLOSED position while a finger in a grating space has prevented the movable grating from moving toward CLOSED position.

If there is an object interfering with the closing movement of grating 12, as with the finger of FIG. 6 then the drive means and rod 16, with attachment 18, move toward OPEN position but grating 12 is prevented from movement because of blockage by the finger, while spring 26 merely stretches, see FIG. 6.

In the normal course the finger (or another object is moved before further control movements take place. When the drive moves toward OPEN position the rod 16 will move with attachment 18 which contacts and moves attachment 22 and grating 12 to OPEN position.

What is claimed is:

1. A stationary and movable grating, drive means moving said movable grating between OPEN and CLOSED positions relative to said stationary grating, said drive means connected to drive said movable grating toward CLOSED position through a yieldable connection, said drive means connected to directly drive said movable grating toward OPEN position, wherein said drive means is connected, before driving said movable grating toward OPEN position, to remove any slack in the system due to yielding in movement toward CLOSED position.

2. Means as claimed in claim 1 wherein said drive means comprises a telescoping drive rod.

3. Means as claimed in claim 2, where said drive means is connected to drive said movable grating toward CLOSED position through a resiliently stretchable tensile member, said tensile member urging said telescoping drive rod toward a non-telescoped, shortened, configuration.

4. Room air grating assembly comprising:

a first stationary grating, a second grating movable between OPEN and CLOSED positions, drive means connected to drive said second grating from OPEN toward CLOSED position through a yieldable connection, said drive means connected to directly drive said second grating during travel from CLOSED to OPEN position, wherein said drive means will move slack in the drive toward OPEN position before directly driving said second grating.

5. Grating as claimed in claim 4, wherein said drive means is connected to said second grating through a resilient tension member arranged to yieldably drive said second grating toward CLOSED position.

6. Grating as claimed in claim 5, wherein said resilient tension member is a coiled spring.

7. Grating as claimed in claim 4, wherein an attachment to drive means contacts an attachment on said second grating to move the latter toward OPEN position.

8. Grating as claimed in claim 7, wherein guide means is provided guiding said drive means when moving toward OPEN position.

9. Room air grating assembly comprising:

a first stationary grating, a second grating movable between OPEN and CLOSED positions relative to said first grating, drive means moveable with an attachment adapted to contact an attachment on said second grating to yieldably move the latter toward CLOSED position, wherein said drive means on movement in an OPEN direction causes said second grating to move toward OPEN position after removing any slack due to an earlier yielding.

10. Room air grating as claimed in claim 9, wherein a resilient tension member connects said second grating and said drive means, allowing said drive means to draw said second grating yieldably toward CLOSED position.

11. Means as claimed in claim 1, wherein said resiliently stretchable tensile member is a helical spring.

12. Means as claimed in claim 3 wherein removing any slack in the system due to yielding in movement toward CLOSED position comprises moving said telescoping drive rod to said non-telescoped, shortened, configuration.

13. Means as claimed in claim 3 wherein said drive means comprises a rotary motor driving an eccentric cam, said eccentric cam connected to one end of said telescoping drive rod.

14. A grating system, comprising:

a stationary grating;

a movable grating;

a drive connected to drive said movable grating toward a closed position through a yieldable connection such that said yieldable connection may yield during movement toward said closed position thereby creating slack;

said drive connected to directly drive said movable grating toward said open position after first removing any said slack.

15. The system of claim 14 wherein said drive comprises a telescoping drive rod.

16. The system of claim 15 wherein said slack exists when said telescoping drive rod is not in a non-telescoped, shortened, configuration.

* * * * *